US006933480B2

(12) United States Patent
Ohta

(10) Patent No.: US 6,933,480 B2
(45) Date of Patent: Aug. 23, 2005

(54) IMAGE HEATING APPARATUS

(75) Inventor: Tomoichirou Ohta, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/396,490

(22) Filed: Mar. 26, 2003

(65) Prior Publication Data

US 2004/0007569 A1 Jan. 15, 2004

(30) Foreign Application Priority Data

Mar. 29, 2002 (JP) ..... 2002/095138
Apr. 10, 2002 (JP) ..... 2002/107319

(51) Int. Cl.[7] ..... H05B 6/10
(52) U.S. Cl. ..... 219/635; 219/619; 219/645; 219/659; 219/660
(58) Field of Search ..... 219/600, 618, 219/619, 635, 645, 647, 652, 653, 655, 659, 660, 672, 676; 399/328, 330, 334, 335, 336

(56) References Cited

U.S. PATENT DOCUMENTS

| | | | | |
|---|---|---|---|---|
| 5,942,882 | A | 8/1999 | Ohta | 323/282 |
| 6,188,054 | B1 | 2/2001 | Ohta | 219/663 |
| 6,198,901 | B1 | 3/2001 | Watanabe | 399/328 |
| 6,483,088 | B2 * | 11/2002 | Uehara et al. | 219/619 |
| 6,661,991 | B2 * | 12/2003 | Naito et al. | 219/619 |
| 2001/0016132 | A1 | 8/2001 | Nanataki et al. | 399/330 |

FOREIGN PATENT DOCUMENTS

JP 60-140280 7/1985

* cited by examiner

*Primary Examiner*—Tu Hoang
(74) *Attorney, Agent, or Firm*—Fitzpatrick, Cella, Harper & Scinto

(57) ABSTRACT

A heating apparatus includes a coil for generating a magnetic field; a heating element for generating heat by eddy currents generated by the magnetic field; an electroconductive member for generating an electromotive force by a current flowing through the coil; and an electric circuit for generating a voltage by electrical collection from the electroconductive member.

12 Claims, 8 Drawing Sheets

IMAGE HEATING APPARATUS

The present invention relates to a DC voltage generating device using an induction heating type type.

An image forming apparatus of an electrophotographic type includes heating means (roller, endless belt member or the like) and pressing means (roller, endless belt member or the like) which are rotated while being in press-contact with each other to form a nip through which a transfer material electrostatically carrying toner which is made of resin material, magnetic particle, coloring material and so on. While it is passed through the press-contact portion (nip), the toner is fused and fixed.

The fixing device may be of a halogen heater type, wherein the heat is produced. In this type, a halogen heater is provided in a fixing roller to radiate heat to the inner surface of the fixing roller such that outer surface of the fixing roller is maintained at a predetermined temperature. However, with this method, the space existing between the halogen heater and the fixing roller has to be heated the heat loss is relatively large. In addition, since the fixing roller is indirectly heated by the halogen heater, the start-up time is relatively long.

As a measure to solve such problems, an induction heating type fixing device attracts attention.

In this type, a high frequency current is applied to an excitation coil to generate a high frequency magnetic field which acts on the inner surface layer of the heat roller, thus generating eddy currents in the electroconductive layer of the fixing roller. The eddy current generates joule heat, so that self-heat-generation occurs in the heat roller per se.

With this heating method, the inner surface layer of the heat roller itself is a heat generating element (direct heating), and therefore, the heat generating efficiency is high, and the heat roller can be quickly heated up to the required fixing temperature. This accomplishes quick start-up. In addition, the electric power using efficiency is high, and therefore, the electric energy consumption can be significantly reduced.

Here, the inner surface of the fixing roller opposed to the excitation coil is a metal layer (electroconductive layer). with such a structure, an electromotive force is generated in the metal layer by the AC current flowing through the halogen heater or excitation coil, as is known. The electromotive force is influenced by impedance $Z—1/(2\pi fC)$. Where f is a frequency of the AC current flowing through the halogen heater and the excitation coil, C is an electric capacity between the metal layer and the halogen heater or the excitation coil. Normally, the frequency of the halogen heater is equivalent to the frequency of the commercial power source having a frequency of 50 Hz or 60 Hz. On the other hand, the frequency of the AC current flowing through the excitation coil is high enough to generates the sufficient joule heat in the electroconductive layer, for example, 20 KHz–1 MHz. Although the electromotive force is small in the fixing type using the halogen heater, a larger electromotive force is generated in the metal layer in the induction heating type than in the halogen heater type because the frequency is high, and therefore, the impedance is small. It is preferable to utilize the electromotive force.

SUMMARY OF THE INVENTION

Accordingly, it is a principal object of the present invention to utilize an electromotive force generated in an electroconductive member by flow of a current in a coil in an induction heating type. It is another object of the present invention to accomplish saving of electric power consumption.

According to an aspect of the present invention, there is provided a heating apparatus includes a coil for generating a magnetic field; a heating element for generating heat by eddy currents generated by the magnetic field; an electroconductive member for generating an electromotive force by a current flowing through the coil; and an electric circuit for generating a voltage by electrical collection from the electroconductive member.

DESCRIPTION OF THE PREFERRED EMBODIMENTS

Figure 1:
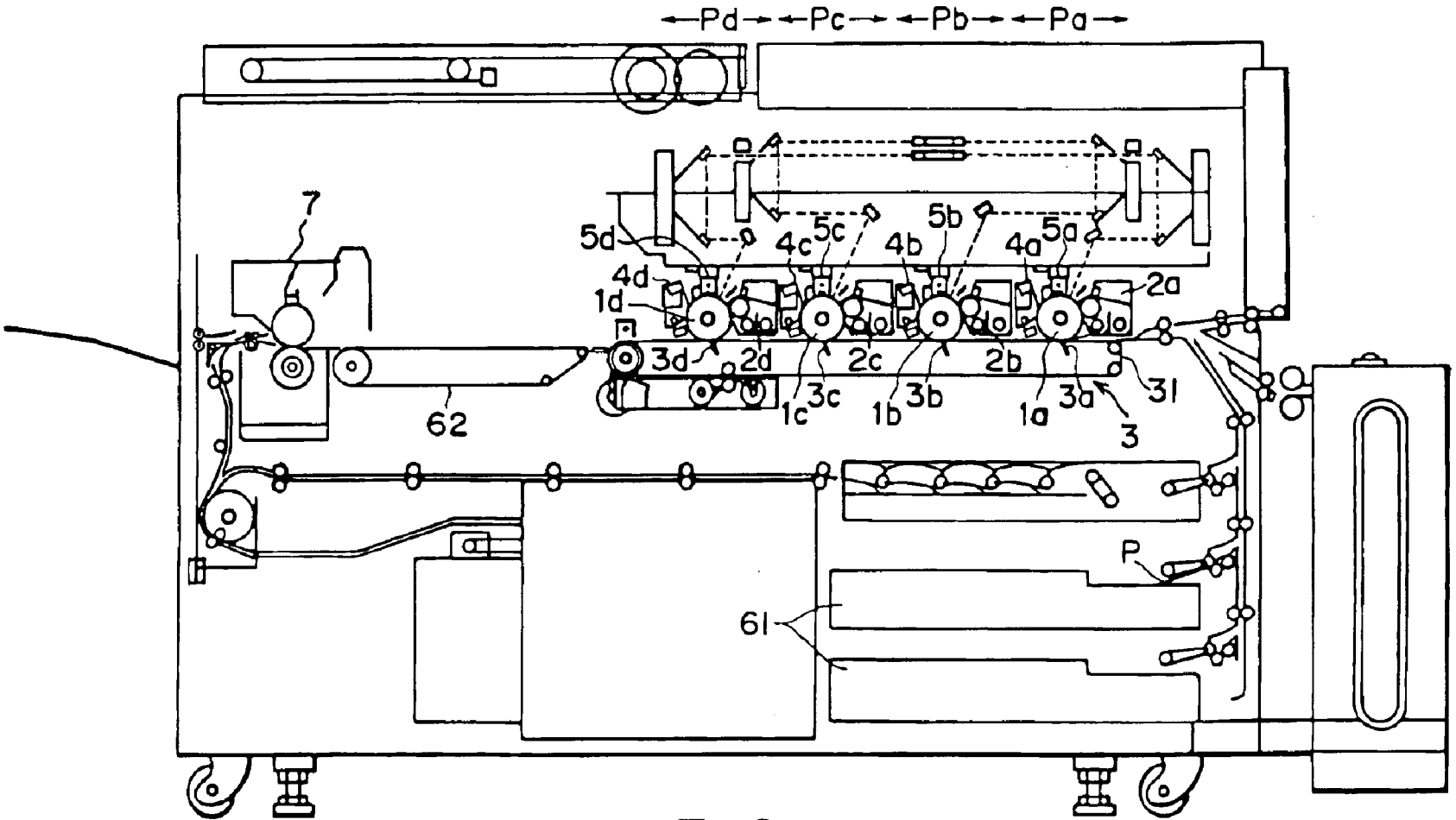
FIG. 1 is a sectional view of an image forming apparatus.

Referring to FIG. 1, the description will be made as to a series of process operations for an image formation.

FIG. 1 substantially shows a structure a 4 drum laser beam printer (printer) including a plurality of light scanning means, as an example of an image forming apparatus according to an embodiment of the present invention. As shown in FIG. 1, the printer of this embodiment comprises four image forming stations (image forming means) each including an electrophotographic photosensitive member as a latent image bearing member (photosensitive drum), and a charging device, developing device, cleaning device and the like around the electrophotographic photosensitive member. Images formed on the photosensitive drums formed in the respective image forming stations are transferred onto a recording material such as paper carried on feeding means passing by the latent image bearing member photosensitive drum.

The image forming stations Pa, Pb, Pc, Pd functions to form images of magenta, cyan, yellow and black colors respectively and have the photosensitive drums 1*a*, 1*b*, 1*c*, 1*d*, and the photosensitive drums are rotatable in the direction indicated by an arrow. As regards the photosensitive drums 1*a*, 1*b*, 1*c*, 1*d*, there are provided chargers 5*a*, 5*b*, 5*c*, 5*d* for electrically charging the surfaces of the photosensitive drums, respectively; developing devices 2*a*, 2*b*, 2*c*, 2*d* for developing image information to which the photosensitive drums 1*a*, 1*b*, 1*c*, 1*d* are exposed after being charged by the chargers 5*a*, 5*b*, 5*c*, 5*d*, respectively; and cleaners 4*a*, 4*b*, 4*c*, 4*d* for removing the residual toner from the photosensitive drum after the images are transferred, respectively. They are disposed in the order named around each of the photosensitive drum 1*a*, 1*b*, 1*c*, 1*d* in the rotational direction. Below the photosensitive drum, there is provided a transfer portion 3 for transferring the toner images from the photosensitive drums onto the recording material. The transfer portion 3 includes a transfer belt 31 (recording material feeding means) which is common to the image forming stations, and chargers 3*a*, 3*b*, 3*c*, 3*d* for transfer charging operations, respectively.

In such a printer, the paper P is supplied from the sheet feeding cassette 61 (recording material supplying means), as shown in FIG. 1, is passed through the respective image forming stations on the transfer belt 31, and received the color toner images from the respective photosensitive drum. By the transfer step, unfixed toner images are formed on the recording material. The recording material P carrying the unfixed toner images is separated from the transfer belt 31 and is transported by a conveyer belt 62 (recording material guiding means) to the fixing device 5.

The description will be made as to the structures of the fixing device 7.

Figure 2:
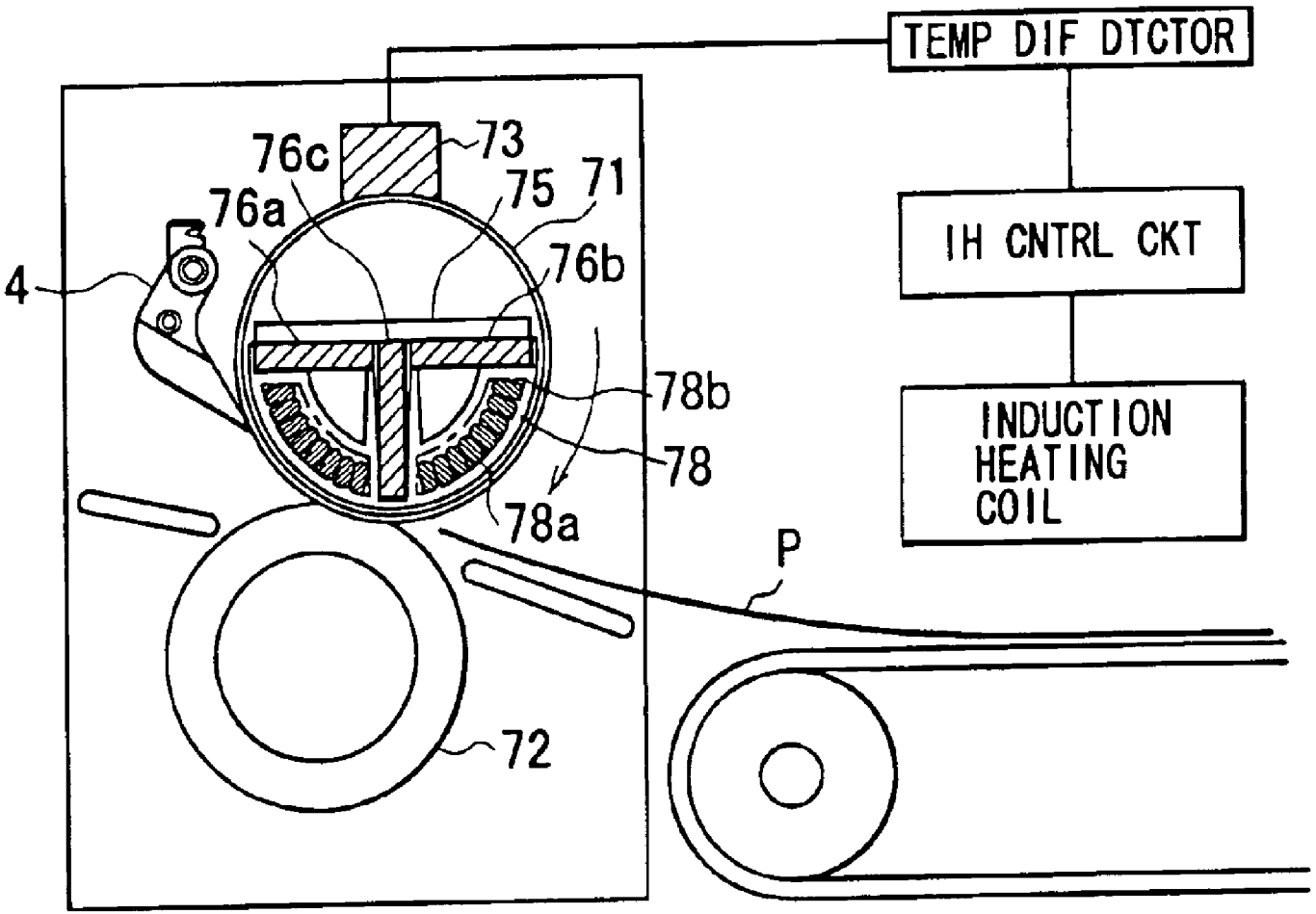
FIG. 2 is a sectional view of an induction heating type fixing device.

FIG. 2 is a sectional view of a fixing device according to an embodiment of the present invention.

Figure 3:
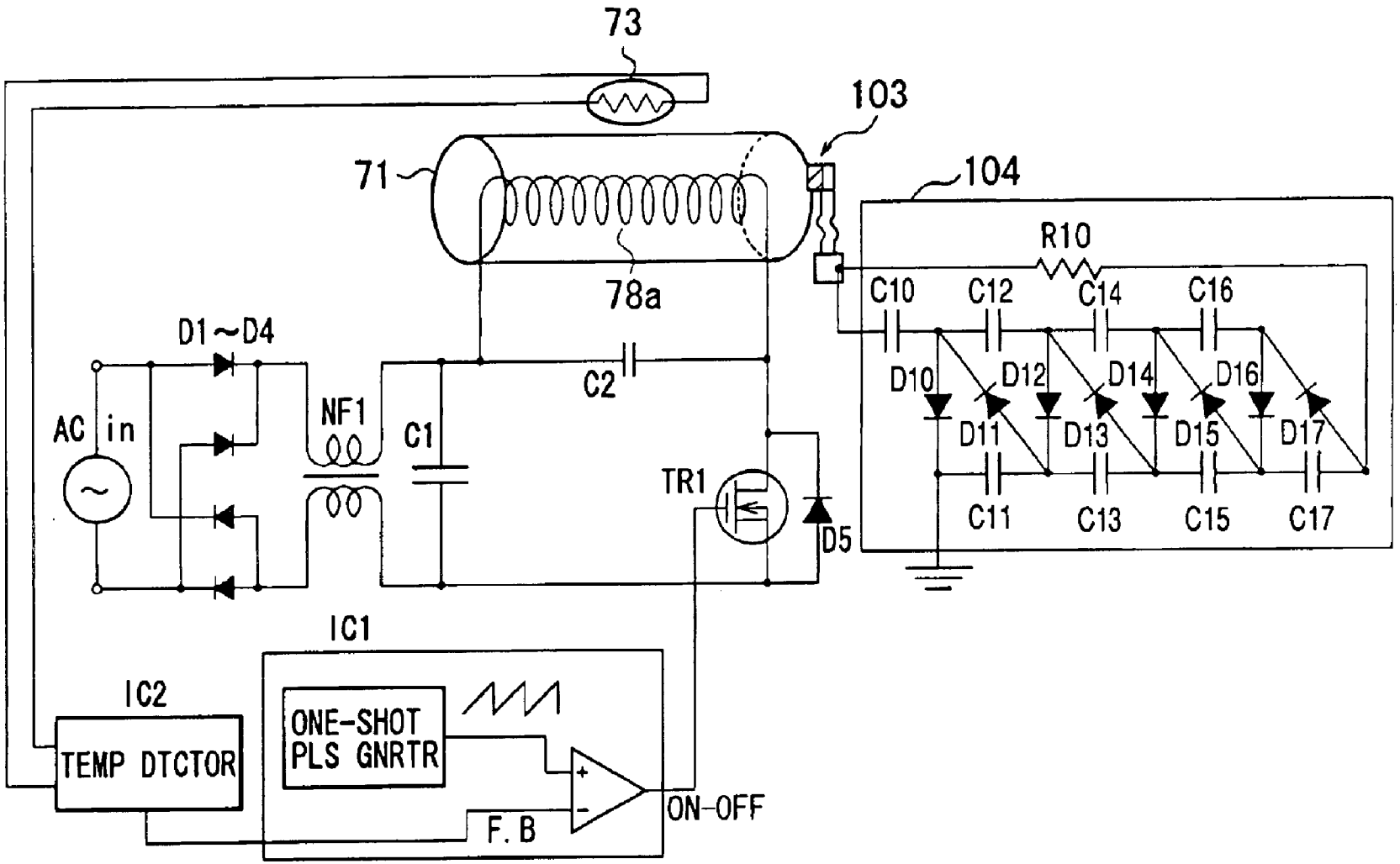
FIG. 3 is a schematic block diagram of a circuit according to a first embodiment of the present invention.

The fixing roller 71 (rotatable member or fixing rotatable member) comprises a core metal cylinder of steel having an outer diameter of 32 mm and a thickness of 0.7 mm, and a parting layer of PTFE or PFA having a thickness of 10–50 μm which improves the surface parting property. As a material of the fixing roller, the use may be made with a magnetic material (magnetic metal) such as magnetic stainless steel that has a relatively high magnetic permeability and a proper resistivity. A non-magnetic material is usable if it is electroconductive (metal)and if it is thin enough. The pressing roller 72 (pressing member) has a core metal made of steel having an outer diameter of 20 mm, an elastic layer of silicone rubber having a thickness of 5 mm on the outer periphery of the core metal, and a parting layer of PTFE or PFA which improves the surface parting property having a thickness of 10–50 μm into an outer diameter of 30 mm, similarly to the fixing roller 71. The fixing roller 71 and the pressing roller 72 are rotatably supported, and the fixing roller 71 is driven to rotate by a motor (driving means). The pressing roller 72 is press-contacted to the surface of the fixing roller 71, and is driven by frictional force at the press-contact portion (nip). The pressing roller 72 is pressed by a mechanism by a spring in an axial direction of the fixing roller 71. The temperature sensor 73 (temperature sensor) is disposed so as to be contacted to the surface of the fixing roller 71, and compares the output of the temperature sensor 73 with the target temperature of the fixing roller 71 in the temperature detecting portion. In accordance with the result of comparison, the fixing roller 71 to the induction coil 78*a* (coil) is increased or decreased by an induction heating control circuit (electric power supply control means or IH control circuit), thus effecting an automatic control to provide a predetermined constant temperature at the surface of the fixing roller 71. Detailed description will be made as to the induction heating coil unit 78 (coil unit). The induction coil 78*a* is supplied with a high frequency electric power of 100–2000 kW, and therefore, it is made of Litz comprising several fine wires. The litz wire is wound and is integrally molded with a resin material (non-magnetic member). The resin material may be PPS, PBT, PET, LCP (liquid crystal polymer) or the like resin material which is non-magnetic. Designated by 76*a*, 76*b* and 76*c* are magnetic cores which comprise high magnetic permeability and low loss material such as ferrite. When an alloy such as permalloy is used, a laminated structure may be used since otherwise the eddy current loss in the core is large when the frequency is high. The core is used to raise the efficiency of the magnetic circuit and to provide a magnetic blocking effect. The coil unit 78 is mounted to a stay 75 and is fixed relative to the fixing device. The description will be made as to an electric circuit of an induction heating type and a rectifying circuit therefor in this embodiment of the present invention. FIG. 3 is a block diagram of an induction heating type fixing device according to the present invention. Designated by TRI is a MOS-FET which is a TRI; C2 is a resonance capacitor for making a resonance waveform from the high frequency AC applied to the dielectric heating coil 78*a* which is a load; D5 is a flywheel diode for regenerating the electric power accumulated in the dielectric heating coil 78*a*. The thermister 73 (temperature sensor) is contacted to the fixing roller 71 in the structure shown in FIG. 4, and the output therefrom is inputted to the temperature detection/comparison circuit IC2. The circuit IC2 compares the input signal for the temperature control and the output from the circuit IC2, and the difference therebetween is fed, as a control signal, to the pulse modulation (PFM) oscillation circuit having the circuit IC1. The circuit IC1 generates PFM pulses in accordance with the control signal value and supplies the output to a gate of the MOS-FET to switch TRI.

Designated by D1–D4 are diodes for input electric energy rectification for rectifying AC, and it supplies rectified pulsating flow to the electric power control circuit portion. A noise filter NF1 and the capacitor C1 constitutes a noise filter and are set to provide such a constant as to give a sufficient attenuation amount is assured with respect to the switching frequency of TR1 and as to pass without attenuation with respect to the voltage source frequency. A collector member 103 is electrically contacted to the fixing roller 71 to keep electric connection, and an electrode thereof is connected with a capacitor C10 and a resistor R10.

The capacitor C10 is connected with diodes D10, D11 and a capacitor C12, and the diodes D10 and D11 are connected to the opposite ends of the capacitor C11 to constitute a so-called doubling rectification circuit.

The description will be made as to the operation.

Figure 5:
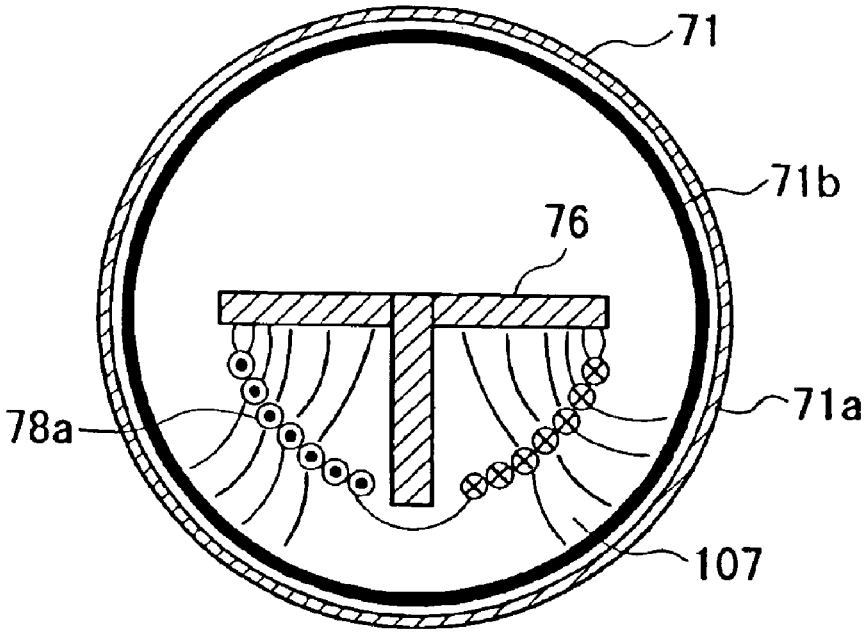
FIG. 5 illustrates a detail of the inside of a heat roller according to the first embodiment.

Referring to FIG. 5, when an AC input voltage is applied to the input terminal, the voltage is rectified by the rectifying element comprising the diodes D1–D4 into pulsating flow, and the voltage thereof is applied across the opposite ends of the capacitor C1 through the noise filter NF1. The end-to-end voltage of the capacitor C1 has a waveform of rectified AC input voltage.

When the temperature control input signal Vc is inputted to the temperature detection/comparison circuit IC2, the temperature detection/comparison circuit IC2 compares the output of the temperature detecting element, namely, the thermister 73 with the target temperature of the input signal Vc. The output indicative of the result of comparison is fed to the PFM oscillation circuit IC1 as a control signal. The comparison circuit IC1 produces a PFM signal having a pulse corresponding to the control signal value, and the output thereof is applied across the gate sources of TR1, which in turn switches in accordance with the output pulse of the circuit IC1 to flow the drain current ID, thus supplying the electric power to the induction coil 78*a*.

Since the induction coil 78*a* accumulates the current provided by actuation of TR1, it generates a counterelectromotive voltage upon deactuation of TR1, by which the cumulative current in the coil is charged into the resonance capacitor C2.

The cumulative current thus supplied raises the resonance capacitor voltage. The current flowing out of the coil 78*a* attenuates in inverse-proportional with rise of the voltage across the resonance capacitor C2 down to zero coil current, and then after the zero point, the charge accumulated in the resonance capacitor C2 produces a current flowing into the induction coil 78*a*.

Thereafter, the charge accumulated in the resonance capacitor C2 returns to the induction coil 78*a*, and simultaneously therewith, the voltage of the induction coil 78*a* lowers such that drain voltage of the TR1 becomes lower than the source voltage, by which the flywheel diode D5 is actuated to produce a forward current. Upon actuation of TR1, the current flows through the induction coil 78*a*, thus repeating accumulation of the current in the induction coil 78*a*. This produces eddy current in the fixing roller 71 which is a load electrically connected with and opposed to the induction coil 78*a*. Thus, the fixing roller 71 made of the electroconductive material generates joule heat which is roller resistance value of itself multiplied by induced current squared.

The current flowing through the switching element TR1 and induction coil 78*a* is smoothed by the capacitor C1 charging and discharge the high frequency component. Therefore, the high frequency current does not flow through the input noise filter NF1, and only the AC-rectified input current waveform flows.

The current flowing through the rectifying diodes D1–D4 has a current waveform provided by filtering the current waveform flowing through the TR1 and the induction heating coil 78*a* with the noise filter constituted by the capacitor C1 and the noise filter NF1, so that AC input current waveform before the rectification approximates the AC input voltage waveform, and therefore, the higher harmonics wave component in the input current can be significantly reduced. This significantly improves a power factor of the input current into the temperature control circuit in the fixing heating circuit. The noise filter NF1 and the capacitor C1 used in the circuit may be any if it provides a filtering effect with respect to the high oscillation frequency provided by IC1. Since the capacity of the capacitor C1 and the inductance value of the noise filter NF1 can be made small, the size and weight can be reduced.

The inputting of the temperature control signal into the dielectric heating voltage source produces a high frequency AC voltage having a frequency of approx. 20 KHz-1 MHz at the output terminal of the induction heating voltage source. The output of the temperature sensor comprising a thermister 73 for measuring a surface temperature of the fixing roller 71 is inputted into the temperature detection/comparison circuit IC2 at proper timing, and is compared with the target temperature, and then difference therebetween is fed back to the circuit IC1. The circuit IC2 functions to generate a feedback signal to maintain a constant surface temperature of the fixing roller using a control system such as a proportional control in which the applied high frequency electric power is decreased when the thermister detected temperature approaches to the set target temperature or a so-called PID.

The circuit IC1 receives the signal indicative of the difference from the target temperature detected by the circuit IC2, and in accordance with the difference, the on-time of the gate of TR1 is determined to adjust the supplied electric power to the TR1, so as to control the electric power supplied to the fixing roller 71. In this manner, the heating value of the roller is controlled, ant the fixing temperature for toner fixing is stabilized. To effect such an effect, a resonance voltage of approx. 100–600V is applied across the induction coil 78*a* disposed inside the fixing roller shown in FIG. 3.

As shown in FIG. 5, electric force lines are generated in the fixing roller 71 which is made of the electroconductive material, by the induction coil 78*a*, so that induced voltage of high frequency corresponding to the oscillation frequency of the induction heating voltage source is generated, that is, the electromotive force is generated, for the fixing roller 71. The induced high frequency voltage is collected from the electroconductive layer of the fixing roller 71 by a collector member 103, and is fed to a bias circuit 104. Thus, when the high frequency current is applied from the dielectric heating voltage source to the induction coil 78*a*, a potential difference $E(L)=\omega Li$ is generated between the opposite ends of the induction heating coil 78*a*, where L=induction coil inductance, i=applied voltage.

The potential difference forms the lines of electric force 107 in the Figure from the surface of the heating coil to the core metal. As a result, the core metal potential generates a potential proportional to the voltage applied to the induction heating coil.

By the bias circuit 104, the high frequency AC voltage injected from the capacitor C10 is rectified by the D10, and the capacitor C10 is charged to the peak value of the AC voltage waveform. The charge accumulated in the capacitor C10 charges capacitor C11 by conduction of D12 in the next cycle, so that capacitor C11 generates a DC voltage corresponding to the cycle of the AC voltage inputted to the capacitor C10.

The capacitor C10, the diodes D10 to D12 and the capacitor C11 constitutes a so-called doubling rectification circuit of one stage. In this example, there is provided a four fold structure, so that 4times voltage rectifying circuit is provided. When, for example, the potential induced in the fixing roller 71 from the induction heating coil 78*a* has a peak-to-peak voltage of 150 Vp-p, a DC potential of −150V is generated by the capacitor C11, and a DC potential of −600V is generated at a connection point between the D17 and a capacitor C17 at the fourth stage.

Figure 4:
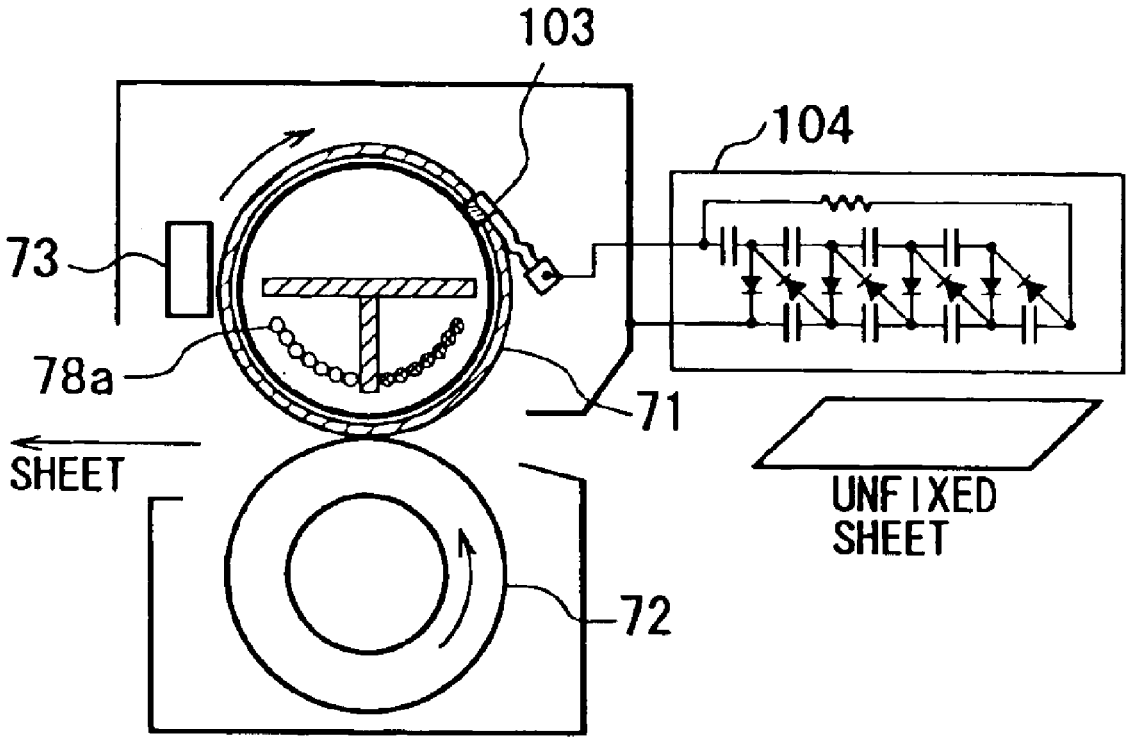
FIG. 4 illustrates a structure of a fixing device using a rectifying bias voltage circuit according to a first embodiment of the present invention.

The DC potential is supplied to a collector member 103 through a limiting resistance R10, by which a DC potential of −600V relative to the ground level can be supplied to the fixing roller 71. The limiting resistor R10 preferably has a resistance value of not less than 1 MΩ. FIG. 4 is a block diagram wherein the above-described system is incorporated in a fixing device. As shown in the Figure, according to this embodiment of the present invention, the bias circuit can be constituted as a circuit block on a printed board or ceramic substrate, and therefore, only two wiring lines are required, wherein one is a wiring line to the collector member and the other is to ground the bias circuit 104, and the circuit structure per se is simple. For this reason, the system can be directly mounted on the outer casing portion of the fixing device, thus accomplishing the roller bias voltage supply with a very simple structure.

In this embodiment, the bias circuit supplies the electric power to the fixing roller 71 for the following reasons. The toner image formed through the image forming process is electrically charged. In order to avoid that toner is deposited onto the fixing roller 71 while passing through the nip (toner offset), the core metal of the fixing roller 71 is supplied with a voltage having the same polarity as the charged potential of the toner. Conventionally, it is necessary to provide an additional bias voltage source for producing the voltage applied to the core metal, so that relatively large space is required, with the result of bulkiness of the image forming apparatus and lager consumption of the electric power. In this embodiment, the fixing roller 71 for fixing the toner which is charged to the negative polarity is supplied with the approx. −600V generated by the bias circuit. The parting layer which is a surface layer of the fixing roller 71 is give a proper degree of electroconductivity to accomplish effective function of the bias potential applied to the core metal 109 for the surface of the fixing roller. In order to raise the parting property of the fixing roller relative to the sheet of paper, the use can be made with an electroconductive Teflon coating (registered Trademark) or tube in place of the parting layer. In this embodiment, the voltage is −600V, but this value is not limiting. As described in the foregoing, in the induction heating type heating apparatus, the electromotive force generated in the electroconductive member by the flow of the current through the coil is utilized to apply a voltage to a part requiring a voltage supply. By doing so, the voltage source can be eliminated so that space and power consumption can be saved.

Second Embodiment

Figure 6:
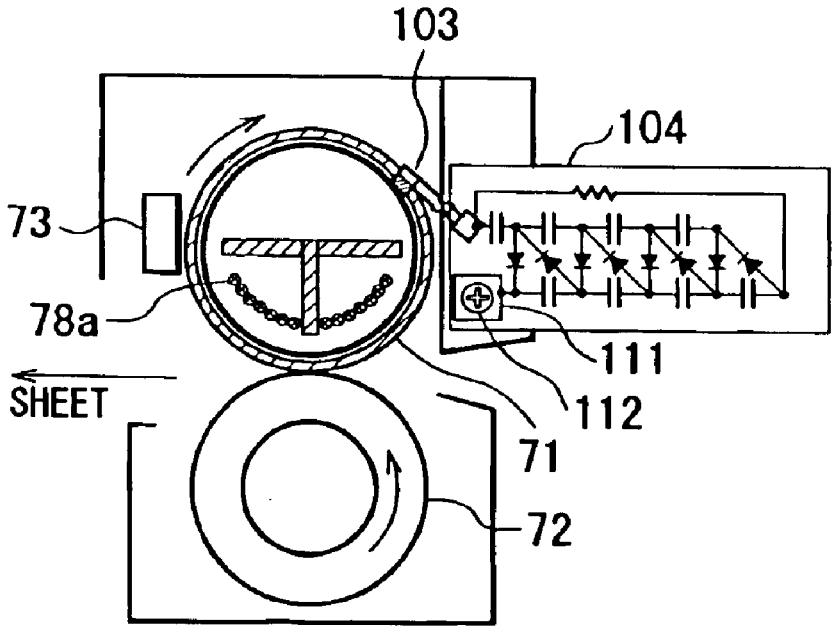
FIG. 6 illustrates a heating apparatus according to a second embodiment of the present invention wherein mounting operation is easy.

FIG. 6 shown an apparatus according to another embodiment of the present invention. Collector member 103 is provided on a bias circuit board 104, and a grounding electrode 111 is provided on the bias circuit board 104. The grounding electrode on the bias circuit board 104 is contacted and electrically grounded to the fixing device casing 102 by a screw 112 for fixed the bias circuit board 104 with the screw bore for fixing to the fixing device casing 102. On the bias circuit substrate, there is provided a sliding electrode, too, which is in sliding contact with the fixing roller 71, and the sliding electrode 103 is so arranged that when the bias circuit 104 is mounted by the screw 112, the sliding electrode 103 is contacted to the fixing roller 71. Therefore, by mounting the bias circuit 104 on the fixing device casing 102 by a mounting screw or the like, the grounding and the contact of the electric energy supply member 103 to the fixing roller is accomplished such that necessity for the roller bias wiring can be eliminated. Thus, the fixing bias can be supplied to the fixing roller 71 with a very simple structure.

Third Embodiment

Figure 7:
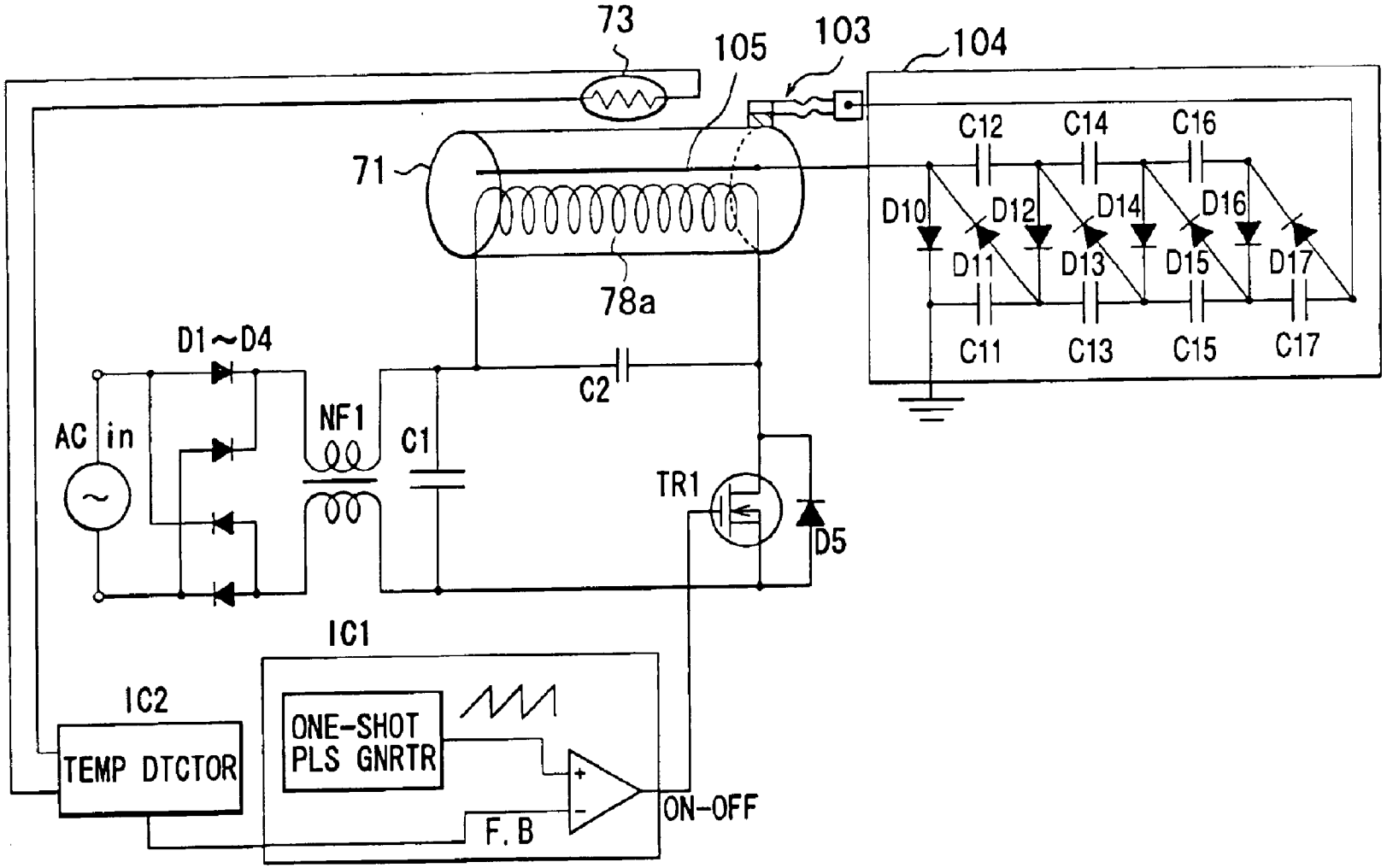
FIG. 7 is a schematic block diagram of a circuit according to a third embodiment of the present invention.

A further embodiment will be described. In the further embodiment, the same reference numerals as with the foregoing embodiment are assigned to the elements having the corresponding functions, and the detailed descriptions for such elements are omitted for simplicity. FIG. 7 is a block diagram of a fixing device actuating circuit of an induction heating type according to a third embodiment of the present invention.

Figure 9:
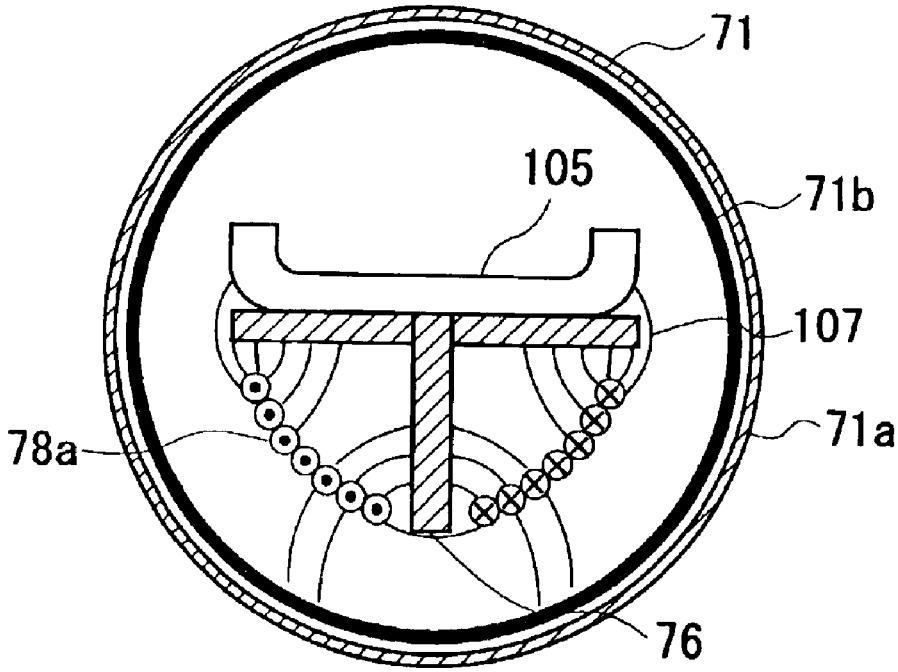
FIG. 9 illustrates a detail of the inside of a heat roller according to the third embodiment.

To the fixing roller 71, an electric energy supply member 103 is electrically contacted to keep the electroconductive state, and the electrode is connected with a bias circuit output terminal 104. In this embodiment, there is provided a collecting electrode 105 of an electroconductive metal such as a steel or the like. The collecting electrode 105 disposed in the fixing roller 71 is connected to the diodes D10, D11 and to the capacitor C12. The diodes D10 and D11 are connected to the opposite ends of the capacitor C11 to constitute a so-called doubling rectification circuit. By flowing the current through the induction coil 78*a*, the heat is generated in the fixing roller 71, similarly to the foregoing embodiment. Here, a resonance voltage of approx. 100–600V is applied across the induction coil 78*a* disposed in the heat generation roller as shown in FIG. 9 to effect a heating operation.

The collecting electrode 105 is made of an electroconductive material which is electrically isolated from the induction coil 78*a*. Lines of electric force are produced for the collecting electrode as shown in FIG. 9. Therefore, an induced voltage is generated for the collecting electrode 105 by a high frequency electromotive force having an oscillation frequency from the induction heating voltage source. The induced high frequency voltage is supplied to the bias circuit 104 to rectify it. In the bias circuit 104, the high frequency AC voltage injected from the collecting electrode 105 is rectified by the diode D11, so that capacitor C11 is charged to a peak value of the AC voltage waveform. The charge accumulated in the capacitor C11 electrically charges the capacitor C12 by electric conduction of the diodes D12 in the next cycle, and a DC voltage corresponding to the peak value of the AC voltage supplied to the capacitor C11 is generated in the capacitor C12. The capacitor C11, diode D10 to diode D12 and capacitor C11 and so on constitute a so-called doubling rectification circuit of one stage. In this example, there is provided a four fold structure, so that 4times voltage rectifying circuit is provided.

Figure 8:
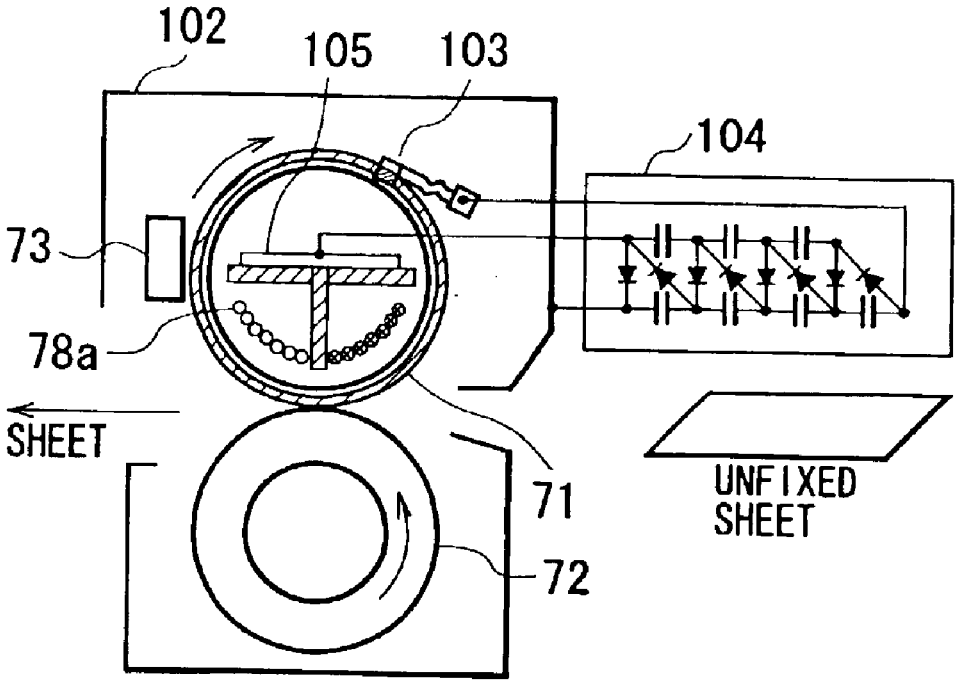
FIG. 8 illustrates a structure of a fixing device using a rectifying bias voltage circuit according to a third embodiment of the present invention.

When, for example, the potential induced in the collector 105 from the induction coil 78*a* has a peak-to-peak voltage of 150 Vp-p, a DC potential of −150V is generated by the capacitor C11, and a DC potential of −600V is generated at a connection point between the diode D17 and capacitor C17 at the fourth stage. The DC potential is supplied to a collector member 103, by which a DC potential of −600V relative to the ground level can be supplied to the surface of the fixing roller 71. FIG. 8 is a block diagram in which the system of the present invention is incorporated in the fixing device. As shown in the Figure, according to this embodiment of the present invention, the bias circuit can be constituted as a circuit block on a printed board or ceramic substrate, and therefore, only the supply wiring line from the collector member 105, a grounding wiring line for grounding the bias circuit 104 and an electric energy supply member 103 for supplying a bias potential to the heat roller 100 are required, and the circuit structure per se is simple. For this reason, the system can be directly mounted on the outer casing portion of the fixing device, thus accomplishing the roller bias voltage supply with a very simple structure. The collecting electrode 105 comprises a ferrite core 76, behind which there is provided an electroconductive material (generally a metal member), and it mechanically supports the induction heating coil 78*a*. Thus, when the high frequency current is applied from the dielectric heating actuating voltage source to the induction coil 78*a*, a potential difference $E(L)=\omega Li$ is generated between the opposite ends of the induction heating coil 78*a*, where L=induction coil inductance, i=applied voltage.

This potential produces lines of electric force 107 for the ferrite core 76 and the collecting electrode 105 at the back side of the induction coil. Since the ferrite core 76 is electroconductive, the line of electric force induces in the ferrite core 76 a potential which is collected through the inside of the ferrite core 76 by the collecting electrode 105. The potential of the collecting electrode 105 is proportional to the applied induction coil voltage. By introducing the voltage to the rectifying circuit, a DC voltage is generated. In this embodiment, the fixing roller 71 is supplied with a voltage having the same polarity as the polarity of the toner to prevent toner offset. The surface layer of the fixing roller 71 has a parting layer 71*a* which has a proper degree of electroconductivity to effectively apply the bias potential applied to the core metal to the surface of the fixing roller. In addition, in order to raise the parting property of the fixing roller relative to the sheet of paper, the use can be made with an electroconductive Teflon coating (registered Trademark) or tube in place of the parting layer 71*a*. By introducing the high frequency potential change to the rectifying circuit 104, the fixing bias potential effective to reduce the fixing offset can be efficiently generated. According to this embodiment, the amount of electric power collected by the collecting electrode 105 is that generated by the collecting electrode per se plus that of the electromotive force generated in the ferrite core 76, and therefore, the electric power generated in the rectifying bias voltage circuit is larger than the power in the foregoing embodiments. Therefore, a high voltage can be generated without use of an external voltage source and without enlarging the rectifying bias voltage circuit.

Fourth Embodiment

Figure 10:
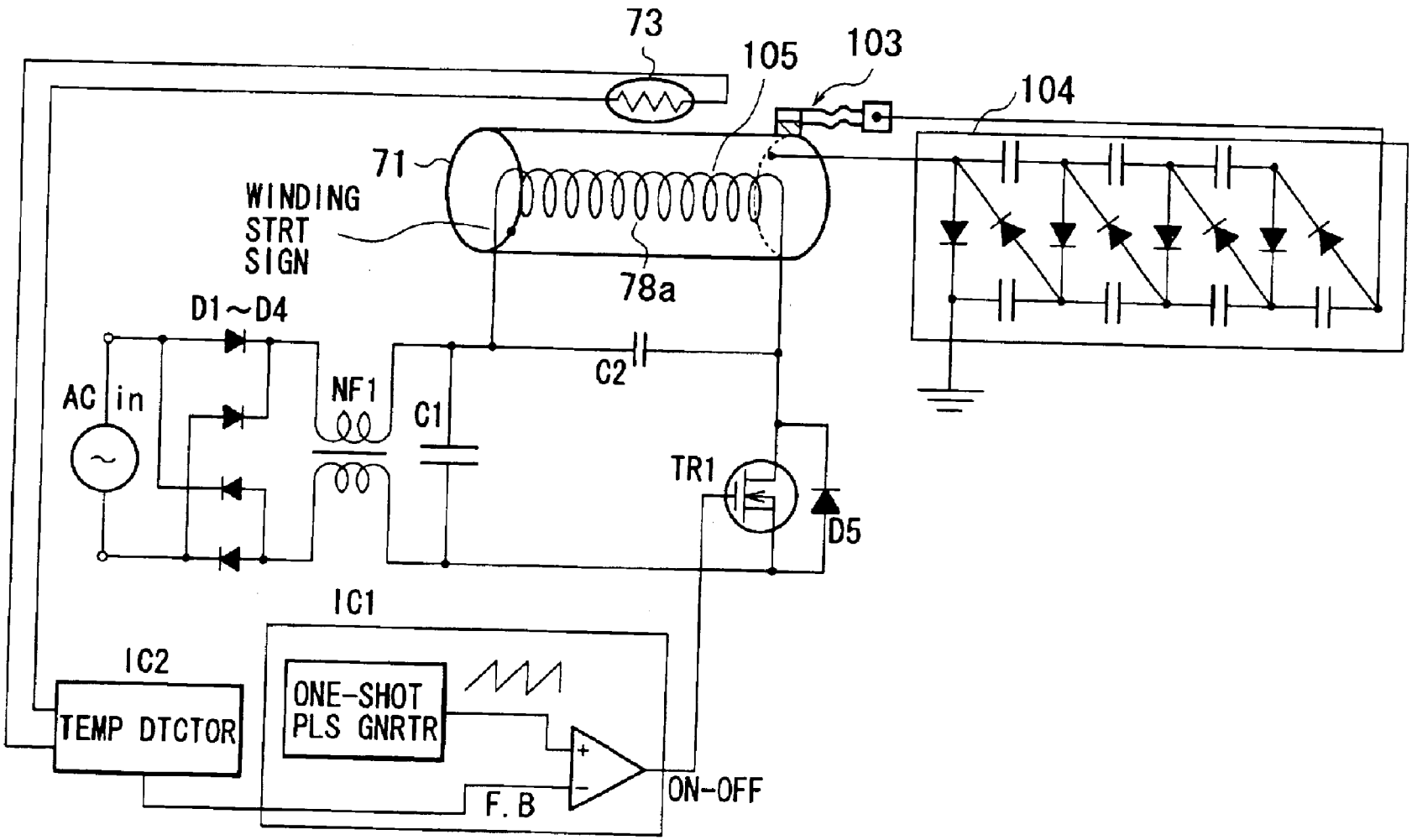
FIG. 10 is a diagram of a circuit according to a fourth embodiment of the present invention using wiring effective to a bias voltage which is efficient.

FIG. 10 illustrates a further embodiment, by which a bias voltage is further efficiently generated. In this embodiment, as shown in FIG. 9, in the function of the lines of electric force on the collecting electrode 105, the lines of electric force generated from the winding end portion of the induction coil 78*a*, functions on the collecting electrode 105 more efficiently than the lines 107 of electric force generated from the winding start portion of the induction coil 78*a* (lower side in FIG. 9); a drain side of a main switch element TR1 of the high frequency power applying device where a highest level of voltage is generated is connected to the end side of the induction heating coil 78*a*; and then, the high frequency potential change can efficiently act on the collecting electrode 105, so that generated voltage by the collecting electrode 105 is higher. By doing so, the number of stages of the doubling rectifications can be reduced. In this embodiment, the voltage is applied to the fixing roller, but it may be supplied to the other portion requiring the voltage application, for example, to a discharging brush for electrically discharging the recording material, or the like. As described in the foregoing, in the induction heating type heating apparatus, the electromotive force generated in the electroconductive member by the flow of the current through the coil is utilized to apply a voltage to a part requiring a voltage supply. By doing so, the voltage source can be eliminated so that space and power consumption can be saved.

While the invention has been described with reference to the structures disclosed herein, it is not confined to the details set forth and this application is intended to cover such modifications or changes as may come within the purpose of the improvements or the scope of the following claims.

What is claimed is:

1. A heating apparatus comprising:

a coil for generating a magnetic flux by receiving high frequency current;

a heat generation member for generating heat by magnetic flux generated by said coil, wherein said heat generation member heat an image on a recording material;

an electroconductive member electrically insulated from said coil, wherein a potential of said electroconductive member is changed on the basis of a potential of said coil which is changed by said high frequency current; and voltage applying means for applying a voltage of a predetermined polarity which is provided by electrically connecting said electroconductive member with a reference point having a potential different from that of said electroconductive member, wherein said voltage applying means is effective to apply the voltage of the predetermined polarity to a predetermined position.

2. An apparatus according to claim 1, wherein said reference point is electrically grounded.

3. An apparatus according to claim 1, wherein said reference point is a point on a casing of the heating apparatus electrically insulated from said coil and said electroconductive member.

4. An apparatus according to claim 1, wherein said voltage applying means has an electric circuit which is a rectifying circuit.

5. An apparatus according to claim 1, wherein said electroconductive member functions also as said heat generation member.

6. An image heating apparatus comprising:

a coil for generating a magnetic flux by receiving high frequency current;

a heat generation member for generating heat by magnetic flux generated by said coil, wherein said heat generation member heats an image on a recording material;

an electroconductive member electrically insulated from said coil, wherein a potential of said electroconductive member is changed on the basis of a potential change of said coil generated by the high frequency current;

an electrical circuit for electrically connecting said electroconductive member with a reference pont having a potential different from that of said electroconductive member, wherein said electrical circuit is effective to generating a voltage of a predetermined polarity by a potential change of said electroconductive member which is changed on the basis of the potential change of said coil; and voltage applying means for applying a voltage of a predetermined polarity to a predetermined position.

7. An apparatus according to claim 1, further comprising a magnetic member for concentrating the magnetic flux from said coil toward said heat generation member, wherein said electroconductive member is contacted to said magnetic member.

8. An apparatus according to claim 1, wherein said high frequency current has a frequency of not less than 20 kHz and not more than 1 MHz.

9. A fixing apparatus comprising:

a coil for generating a magnetic flux by receiving high frequency current;

a heat generation member for generating heat by magnetic flux generated by said coil, wherein said heat generation member is effective to fix an image on a recording material;

an electroconductive member electrically insulated from said coil, wherein a potential of said electroconductive member changes on the basis of a potential of said coil which is changed by said high frequency current; and voltage applying means for applying to a voltage of a predetermined polarity which is provided by electrically connecting said electroconductive member with a reference point having a potential different from that of said electroconductive member, wherein the said voltage applying means is effective to apply a voltage of the predetermined polarity which is the same as a charging polarity of a toner to a surface of said heat generation member.

10. An apparatus according to claim 1, wherein said electroconductive member functions also as a supporting member for mechanically supporting said coil.

11. An apparatus according to claim 9, wherein said electroconductive member functions also as said heat generation member.

12. An image forming apparatus comprising:

image forming means for forming an image on a recording material;

a coil for generating a magnetic flux by receiving high frequency current;

a heat generation member for generating heat by magnetic flux generated by said coil, wherein said heat generation member heats the image on the recording material;

an electroconductive member electrically insulated from said coil, wherein a potential of said electroconductive member is changed on the basis of a potential of said coil which is changed by said high frequency current; and voltage applying means for applying a voltage of a predetermined polarity which is provided by electrically connecting said electroconductive member with a reference point having a potential different from that of said electroconductive member, wherein said voltage applying means is effective to apply the voltage of the predetermined polarity to a predetermined position of said image forming apparatus.

* * * * *

UNITED STATES PATENT AND TRADEMARK OFFICE

CERTIFICATE OF CORRECTION

PATENT NO. : 6,933,480 B2
DATED : August 23, 2005
INVENTOR(S) : Tomoichirou Ohta It is certified that error appears in the above-identified patent and that said Letters Patent is hereby corrected as shown below:

Column 1,
Line 41, “WITH” should read -- With --.
Line 44, “Z__1/(2πfc)” should read -- Z=1/(2πfc), --.
Line 45, “Where” should read -- where --.
Line 52, “generates” should read -- generate --.

Column 2,
Line 2, “includes” should read -- that includes --.
Line 41, “structure” should read -- structure of --.
Line 56, “functions” should read -- function --.

Column 6,
Line 33, “constitutes” should read -- constitute --.

Column 7,
Line 7, “give” should read -- given --.
Line 24, “shown” should read -- shows --.
Line 30, “fixed” should read -- fixing --.
Line 60, “a” should be deleted.

Column 9,
Line 25, “functions” should read -- function --.
Line 58, “heat” should read -- heats --.

UNITED STATES PATENT AND TRADEMARK OFFICE

CERTIFICATE OF CORRECTION

PATENT NO. : 6,933,480 B2
DATED : August 23, 2005
INVENTOR(S) : Tomoichirou Ohta It is certified that error appears in the above-identified patent and that said Letters Patent is hereby corrected as shown below:

Column 10,
Line 27, “pont” should read -- point --.
Line 29, “to” should read -- for --.

Signed and Sealed this

Seventh Day of February, 2006

JON W. DUDAS
*Director of the United States Patent and Trademark Office*